US010106997B2

(12) United States Patent
Stearns et al.

(10) Patent No.: US 10,106,997 B2
(45) Date of Patent: Oct. 23, 2018

(54) SYSTEMS AND METHODS FOR REMOVING PRECIPITATION FROM AN EXTERIOR OF A BUILDING

(71) Applicant: Extell Development Company, New York, NY (US)

(72) Inventors: Joaquin F. Stearns, Glen Ridge, NJ (US); Gary Barnett, Richmond Hill, NY (US); Joseph Montano, Douglaston, NY (US); Shawn Kirk, Ramsey, NJ (US)

(73) Assignee: EXTELL DEVELOPMENT COMPANY, New York, NY (US)

( * ) Notice: Subject to any disclaimer, the term of this patent is extended or adjusted under 35 U.S.C. 154(b) by 0 days.

(21) Appl. No.: 15/802,841

(22) Filed: Nov. 3, 2017

(65) Prior Publication Data

US 2018/0127995 A1 May 10, 2018

Related U.S. Application Data

(60) Provisional application No. 62/417,930, filed on Nov. 4, 2016.

(51) Int. Cl.

| | |
|---|---|
| ***A47L 1/02*** | (2006.01) |
| ***E04G 23/00*** | (2006.01) |
| ***E04D 13/10*** | (2006.01) |
| ***B08B 1/00*** | (2006.01) |

(52) U.S. Cl.

CPC ..... *E04G 23/002* (2013.01); *A47L 1/02* (2013.01); *B08B 1/008* (2013.01); *E04D 13/106* (2013.01); *B08B 1/005* (2013.01)

(58) Field of Classification Search

CPC ..... A47L 1/02; E04G 23/002

See application file for complete search history.

(56) References Cited

U.S. PATENT DOCUMENTS

| | | | | |
|---|---|---|---|---|
| 3,080,592 | A | 3/1963 | Hassage | |
| 4,797,969 | A | 1/1989 | Caduff | |
| 5,249,326 | A * | 10/1993 | Jefferies | A47L 1/02 15/103 |
| 7,007,334 | B2 | 3/2006 | Thurnher | |
| 7,523,517 | B2 * | 4/2009 | Yu | E04G 23/002 15/103 |

(Continued)

FOREIGN PATENT DOCUMENTS

DE 3923070 A1 1/1991

*Primary Examiner* — Randall Chin

(74) *Attorney, Agent, or Firm* — Bryan Cave Leighton Paisner LLP

(57) ABSTRACT

This disclosure relates to systems, methods and apparatuses for removing precipitation from an exterior of a building in an expedited and automated fashion. The precipitation removal system includes one or more sweeper assemblies and one or more hoisting assemblies. The sweeper assemblies are suspended from the roof, ledge or other portion of a building. The hoisting assemblies assist the sweeper assemblies with vertically traversing the exterior of the building. As a sweeper assembly vertically traverses the side of the building, precipitation that accumulates on the exterior of the building is removed. The sweeper assemblies can remove precipitation from connecting structures on the exterior of the building which are used by building maintenance personnel to perform maintenance operations on the exterior of the building.

10 Claims, 12 Drawing Sheets

(56) References Cited

U.S. PATENT DOCUMENTS

| | | | |
|---|---|---|---|
| 7,823,242 | B2 | 11/2010 | Gorman |
| 8,661,598 | B2 | 3/2014 | Alshehhi |
| 2003/0106176 | A1 | 6/2003 | Wang |
| 2006/0048800 | A1 | 3/2006 | Rast et al. |
| 2009/0044833 | A1 | 2/2009 | Simonette |
| 2009/0100618 | A1 | 4/2009 | Chen |

* cited by examiner

SYSTEMS AND METHODS FOR REMOVING PRECIPITATION FROM AN EXTERIOR OF A BUILDING

CROSS-REFERENCE TO RELATED APPLICATIONS

The present application claims the benefit of U.S. Provisional Application No. 62/417,930 filed on Nov. 4, 2016, the content of which is herein incorporated by reference in its entirety.

TECHNICAL FIELD

The present disclosure is directed to systems, methods and apparatuses for removing precipitation from an exterior of a building and, more particularly, to techniques for removing precipitation from connecting structures located on the exterior of the building.

BACKGROUND

Skyscrapers and other large buildings include structures that permit a scaffolding structure or other platform to be suspended from the top of a building. For example, an exterior of a building may include mullions, tracks or other connecting structures that are attached to a platform which moves up and down the side of a building to enable individuals to manually clean windows or to perform other maintenance operations. A control system on the platform permits the platform to move along the exterior of a building while the connecting structures guide the movement of the platform.

An accumulation of snow, ice or other forms of precipitation on the connecting structures may prevent the platforms from being utilized. In addition, the accumulation of precipitation could be dangerous to individuals and vehicles in the vicinity of the building. After the precipitation has accumulated to a certain threshold and its weight becomes too great, it could naturally fall down to the ground as a result of the Earth's gravity or just be blown away by wind. This situation is particularly dangerous when the precipitation falls from a high altitude (e.g., an upper portion of a skyscraper or other tall building) and/or when the precipitation is in a solid state (e.g., such as an icicle).

Traditional techniques for removing precipitation from connecting structures, or other exterior portions of a building, are labor-intensive and inefficient. Manually removing precipitation from the exterior of a building using handheld tools takes a very long time, especially in cases in which the building is a skyscraper or includes many levels or floors. By the time the individuals have completely traversed the exterior of a building, the individuals are often required to repeat the process because more precipitation has accumulated on the portions of the exterior where the precipitation was previously removed. Aside from the slow and inefficient nature of the precipitation removal process, these manual techniques require the individuals who are removing the precipitation to endure harsh weather conditions while they do so.

In view of the foregoing, there is a need for unmanned and automated precipitation removal systems, methods and apparatuses which have the ability to quickly and efficiently remove precipitation from an exterior of a building before the precipitation is able to accumulate.

SUMMARY

The inventive principles described in this disclosure relate to systems, methods and apparatuses for removing snow, ice, frost and other forms of precipitation from the exterior of buildings. The buildings include connecting structures (e.g., mullions or tracks) which enable maintenance personnel to traverse the exterior of the building in order to perform maintenance operations (e.g., window cleaning or repairs). A precipitation removal system includes an unmanned sweeper assembly that removes precipitation from the connecting structures and other exterior portions of the building. The sweeper assembly can include various types of precipitation removal tools (e.g., scrapers, sleeves and/or heating elements) to remove the precipitation. Removal of the precipitation enables the maintenance personnel to perform maintenance operations on the exterior of the building, and eliminates or reduces the risk that precipitation will accumulate to dangerous levels which could cause harm to individuals or property if the precipitation was to fall or become dislodged from the exterior of the building. The inventive precipitation removal techniques are fully automated, thus allowing the precipitation to be removed quickly and efficiently, and avoiding manual, removal labor-procedures which cause individuals to endure harsh weather conditions.

In accordance with certain embodiments, a system is provided for removing precipitation from an exterior of a building. The system includes a sweeper assembly which is configured to traverse the exterior of the building and remove precipitation from the exterior of the building. The sweeper assembly includes: a plurality of attachment members that connect the sweeper assembly to connecting structures located on the exterior of the building; one or more precipitation removal tools that are configured to remove precipitation from the connecting structures; and a bar member that is connected to the plurality of attachment members. The system also includes a hoisting assembly that is connected to the sweeper assembly and which is configured to lower and raise the sweeper assembly along the exterior of the building.

In accordance with certain embodiments, a method is provided for removing precipitation from an exterior of a building. The method includes the step of providing a precipitation removal system that comprises: a sweeper assembly that is configured to traverse the exterior of the building and remove precipitation from the exterior of the building. The sweeper assembly includes: (a) a plurality of attachment members that connect the sweeper assembly to connecting structures located on the exterior of the building; (b) one or more precipitation removal tools that are configured to remove precipitation from the connecting structures; and (c) a bar member that is connected to the plurality of attachment members. The sweeper assembly further includes a hoisting assembly that is connected to the sweeper assembly and which is configured to lower and raise the sweeper assembly along the exterior of a building. The method further includes the step of activating the precipitation removal system.

The foregoing and other features and advantages will become apparent from the following detailed description of illustrative embodiments thereof, which is to be read in connection with the accompanying drawings.

BRIEF DESCRIPTION OF THE DRAWINGS

The inventive principles are illustrated in the figures of the accompanying drawings which are meant to be exemplary and not limiting, in which like references are intended to refer to like or corresponding parts, and in which.

DETAILED DESCRIPTION OF EXEMPLARY EMBODIMENTS

The present disclosure relates to systems, methods and apparatuses for removing precipitation from connecting structures located on an exterior of a building in an expedited fashion using an unmanned, remotely-controlled precipitation removal system. The precipitation removal system includes one or more sweeper assemblies and one or more hoisting assemblies. Each sweeper assembly is suspended from the roof, ledge or other portion of a building and removes precipitation from the exterior of the building. Each sweeper assembly is attached to a hoisting assembly that causes the sweeper assembly to vertically traverse the exterior of the building. As a sweeper assembly vertically traverses the side of the building, the assembly removes any ice, snow, rain, frost and other forms of precipitation that may accumulate on the connecting structures located on the exterior of the building by sweeping away any accumulations. The sweeper assembly can also be configured to remove precipitation from other exterior portions of the building (e.g., exterior walls, windows or structures).

As described above, building maintenance personnel utilize suspended scaffolding structures or other platforms to perform other maintenance operations (e.g., cleaning windows or repairing structures on the exterior of the building). The scaffolding structures or other platforms can be connected to mullions, tracks or other connecting structures on the exterior of the building. The platforms utilize the connecting structures to guide movement of the platforms along the exterior of the building. However, an accumulation of precipitation on the connecting structures may prevent the platforms from being utilized, thus, preventing the maintenance personnel from performing the maintenance operations. The precipitation removal system described herein is configured to prevent precipitation from accumulating on the connecting structures, and is able to remove any accumulated precipitation from the connecting structures and other exterior portions of the building.

Figure 1A:
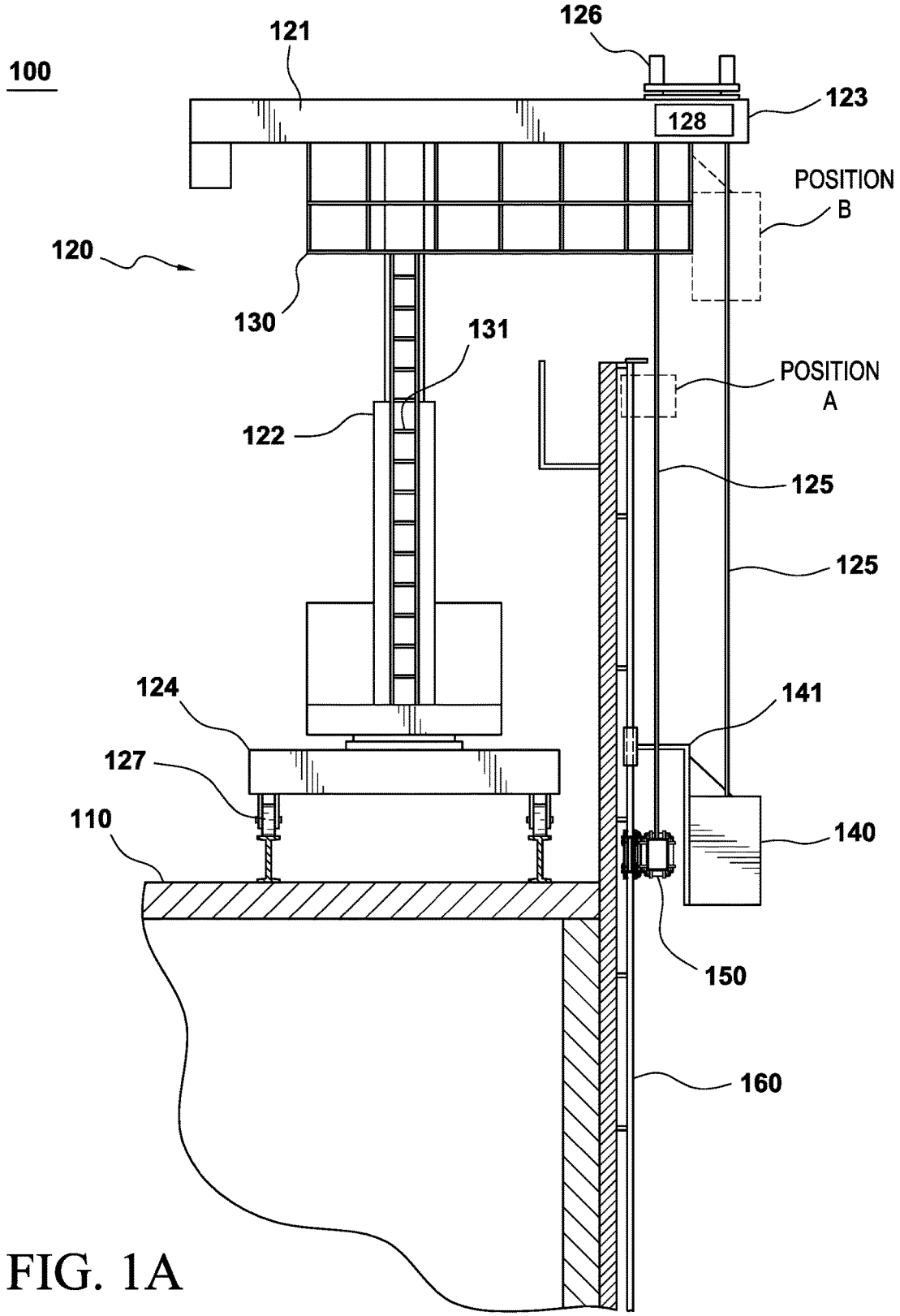
FIG. 1A is a cross-sectional view of a building that includes a precipitation removal system in accordance with certain embodiments.
Figure 1B:
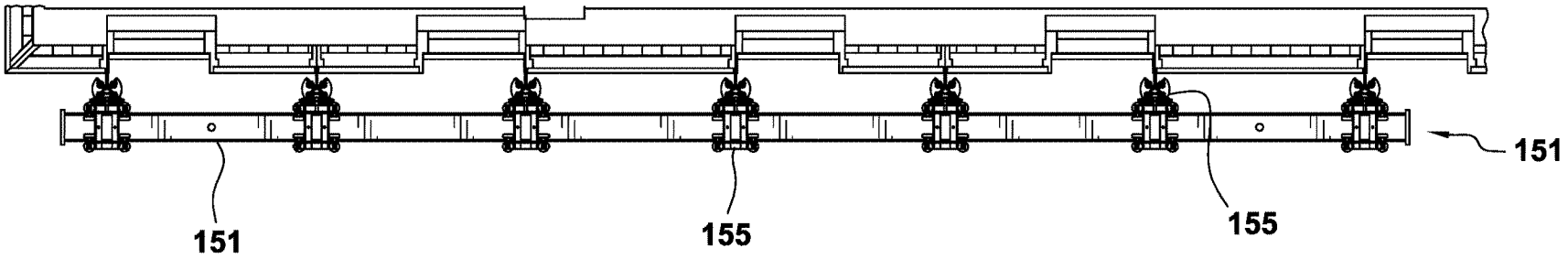
FIG. 1B is a plan view of a building that includes a precipitation removal system in accordance with certain embodiments.
Figure 1C:
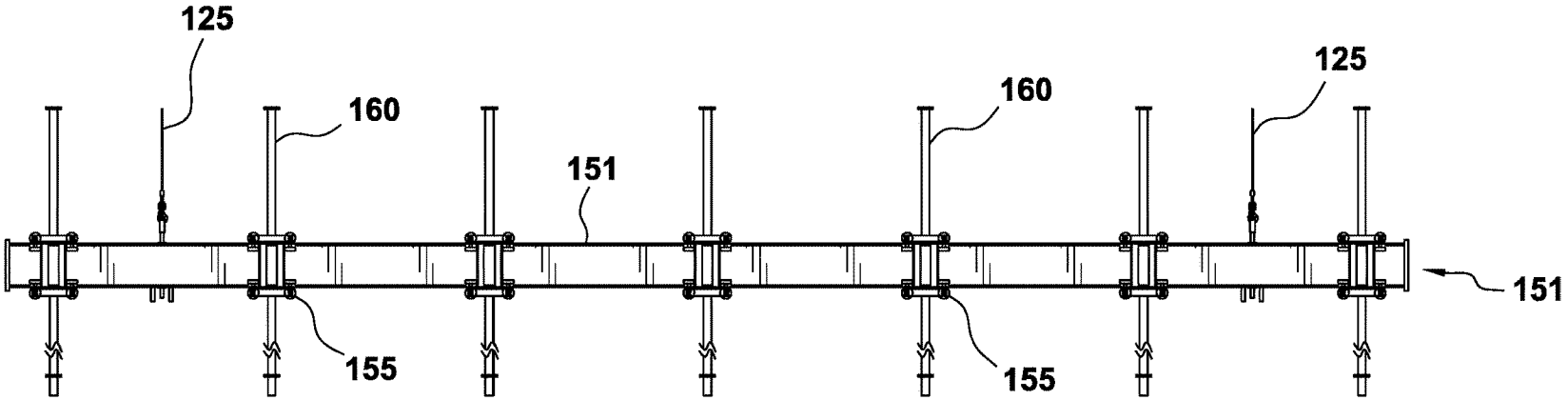
FIG. 1C is a side view of a building that includes a precipitation removal system in accordance with certain embodiments.

FIGS. 1A-1C illustrate an exemplary precipitation removal system 100 that is configured to provide assistance with removing precipitation from the exterior of a building 110. FIG. 1A is a cross-sectional view of a building 110 that includes the precipitation removal system 100 in accordance with certain embodiments. FIG. 1B is a plan view of a building 110 that includes a precipitation removal system 100 in accordance with certain embodiments. FIG. 1C is a side view of a building 110 that includes a precipitation removal system 100 in accordance with certain embodiments.

While only one precipitation removal system 100 is illustrated, it should be understood that the building 110 can include a plurality of precipitation removal systems 100 positioned at different locations of the building 110 (e.g., one or more on each side of the building). The precipitation removal systems 100 include hoisting assemblies 120 that are configured to move sweeper assemblies 150 along connecting structures 160 included on the side of the building 110 in order to remove precipitation from the connecting structures 160 and/or other portions of the building 110. The hoisting assemblies 120 can be situated on the roof of the building 110 or on other portions of the building (e.g., terraces or outwardly extending portions of the building) which provide access to the connecting structures 160.

The configuration of the hoisting assemblies 120 may vary according to different embodiments and building design features, and can generally include any assembly or apparatus that assists a sweeper assembly 150 with traversing the exterior of the building 110. In certain embodiments, a hoisting assembly 120 comprises one or more davit structures 121 (or other similar structures) that include an upwardly extending mast portion 122 and a boom portion 123 that extends past the ledge of the building 110. A base structure 124 or carriage is attached to a roof, ledge or other portion of the building 110. The base structure 124 sits on track assembly 127 which permits the hoisting assembly to be moved to different locations. A double cross boom 126 is attached to the end of the boom portion 123 which extends over the building 110 and is situated perpendicular with respect to the boom portion 123. The boom portion 123 is configured to be telescopic, thereby permitting the boom portion 123 to retract and expand. Cables 125 extend down from the cross boom 126 and attach to the sweeper assembly 150 located on the side of the building 110. In particular, the cables 125 may extend through and attach to portions of a horizontal bar member 151 included in the sweeper assembly 150. Each cable 125 may be attached to one or more motorized winches 128 (and/or other portion of the davit structure 121) that causes a retraction or extension of the cable 125 so as to cause the vertical movement of the sweeper assembly 150 along the exterior the building 110. The motorized winches may be located at the end of the boom portion 123 and/or in other locations. The sweeper assembly 150 may also include a locking mechanism which secures the sweeper assembly 150 to the connecting structures 160 or other portions of the building 110 when the sweeper assembly 150 is not in use. For example, when the sweeper assembly 150 is not being utilized, it can be retracted to an upright position (Position A in FIG. 1) and a locking mechanism can be utilized to secure the sweeper assembly to the connecting structures 160.

The configuration of the sweeper assembly 150 can also vary. The sweeper assembly 150 can generally represent any assembly that assists with removing precipitation from the connecting structures 160 and/or other exterior portions of the building 110. In certain embodiments, the sweeper assembly 150 comprises one or more bar members 151 that extend horizontally with respect to the exterior of the building 110. In certain embodiments, the sweeper assembly 150 also comprises one or more attachment members 155 which serve to connect the bar member 151, and other portions of the sweeper assembly 150, to a connecting structure 160 located on the exterior portion of the building 110. In the exemplary embodiment shown in FIG. 1, the connecting structures 160 include mullions, rods or bar structures and the attachment members 155 are connected to the mullions or bar structures and guide the sweeper assembly 150 up and down the mullions or bar structures. However, the configuration of the attachment members 155 can vary and can be configured to attach to the sweeper assembly 150 to any type of connecting structure 160. For example, the attachment members 155 may connect the sweeper assembly 150 to one or more mullions, rails, tracks, bars or other connecting structures 160 which are attached to, and which extend vertically along, the exterior of the building 110.

As mentioned above, the attachment members 155 and connecting structures 160 can be configured in any number of ways to permit the sweeper assembly 150 to be secured to the building 110 and to move along the exterior of the building. In certain embodiments, the attachment members 155 and connecting structures 160 are configured to mate using corresponding male or female structures. For example, as shown in FIGS. 1A-1C, the connecting structures 160 on a building may include mullions that comprise male configurations or structures, while the attachment members 155 are configured with corresponding female configurations or structures (e.g., such as a sleeve or trolley) that are able to mate with the male mullions. Alternatively, the connecting structures 160 on the building 110 may include female track-like configurations and the attachment members 155 may include corresponding male portions that are received by the tracks. Other types of connection mechanisms may also be utilized. Regardless of the particular connection mechanism that is selected, the connecting structures 160 on the building 110 can assist with guiding the sweeper assembly 150 vertically along the exterior of the building 110 in response to a retraction or extension of the cables 125 by the motorized winches 128 or other devices.

The attachment members 155 and/or other portions of the sweeper assembly 150 may include precipitation removal tools (e.g., sleeves, wipers or scrapers) that are configured to remove ice, snow and other forms of precipitation from the connecting structures 160 and/or other exterior portions of a building 110 as the sweeper assembly 150 vertically traverses the exterior of the building 110. In certain embodiments, the precipitation removal tools 170 (shown in FIGS. 2C, 2D, 3B and 3D) may include an edge or surface that physically contacts the connecting structures 160 and removes the precipitation from the connecting structures 160. In certain embodiments, the precipitation removal tools 170 may include a snow removal tool which is capable of removing soft precipitation (e.g., snow, sleet or rain) from the connecting structures 160 and an ice removal tool which is capable of scraping off and removing hard precipitation (e.g., ice) from the connecting structures 160. The snow removal tool may be composed of a polymer (e.g., nylon) or other similar substance, while the ice removal tool may be composed of a metal (e.g., steel) or other similar substance.

In accordance with certain embodiments, in addition to removing precipitation from the connecting structures 160 of a building 110, the precipitation removal system 100 may further be configured to remove precipitation from other exterior portions of the building (e.g., from the windows or other exterior surfaces of the building). To facilitate the removal of precipitation from these additional portions of the building 100, the bar member 151 and/or attachment members 155 of the sweeper assembly 150 may be outfitted with additional precipitation removal tools (e.g., wipers or scrapers) that are situated to contact the windows and other exterior surfaces of the building.

In certain embodiments, the bar members 151 and connecting structures 160 may further include removable end stops which enable the lengths of the bar members 151 and connecting structures 160 to be extended or retracted. For example, the length of the bar member 151 may be extended by removing an end stop located on an end of the bar member 151 and connecting one or more additional bar member sections at the location of the end stop (along with additional attachment members 155 as needed). Likewise, the length of the connecting structures 160 can be extended by removing the end stops and attaching one or more additional connecting structures 160. In certain embodiments, the end stops located on the connecting structures 160 may also serve to restrict the vertical movement of the sweeper assembly.

Although the disclosure herein primarily describes the inventive principles in terms of apparatuses, systems and methods that assist with the removal of precipitation from the exterior of a building 110, it should be recognized that the inventive principles are not to be limited to the disclosed embodiments. For example, in certain embodiments, the inventive principles may be adapted to assist with the removal of precipitation from solar panels or other structures, or may be adapted to assist with washing or cleaning windows of a building. The inventive principles may be adapted for other related purposes as well.

In certain embodiments, the precipitation removal system 100 also includes a retractable platform 140 which is attached to the cross boom 126. In the event that a sweeper assembly 150 is stuck, damaged, deactivated or otherwise requires maintenance, the platform 140 which is able to hold one or more individuals may be deployed to provide assistance. The platform 140 may be attached to and supported by a separate set of cables 125 that are connected to a separate motorized winch 128 of the hoisting assembly 120 (or an entirely separate hoisting assembly 120 in some cases), thus enabling the platform 140 and the sweeper assembly 150 to move independently of one another.

The same or similar hoisting assembly 120 that is utilized to move the sweeper assembly 150 may also be utilized to move the platform 140. For example, both hoisting assemblies may include one or more motorized winches 128 and one or more cables 125 which separately control movement of the sweeper assembly 150 and platform 140. In certain embodiments, the platform 140 is attached using a four point suspension wire system or cable system, while the sweeper assembly 150 is attached using a two point suspension wire system or cable system. The hoisting assembly 120 enables the platform 140 to vertically traverse the side of the building 110 in order to access and perform maintenance on the sweeper assembly 150 and/or building 110.

One or more removable torpedo supports 141 may couple the platform 140 to the connecting structures 160 on the building 110 in order to guide the platform 140 as it ascends and descends. The torpedo supports 141 are preferably configured to contact the connecting structures 160 at a contact point which is located above the platform 140, thus permitting the platform 140 to be located on the same plane as the sweeper assembly 150 during maintenance operations. In certain embodiments, the platform 140 may also be utilized by individuals to clean the windows of the building 110 or to perform other maintenance operations on the exterior of the building 110.

The precipitation removal system 100 also includes a catwalk 130 which extends over the ledge of the building 110 and which enables individuals to access the platform 140. The catwalk 130 can be accessed by a ladder 131 that extends downward near the base portion 124 or the surface of the building 110. The platform 140 and/or catwalk 130 may include a locking mechanism which serves to secure the platform 140 to the catwalk 130 or other portion of the precipitation removal device 100 when the platform 140 is in a raised position and located adjacent to the catwalk 130. For example, when the platform 140 is not being utilized, the platform 140 can be retracted in a raised position (Position B in FIG. 1) and secured to the catwalk 130. In certain embodiments, the platform 140 also may be coupled to the sweeper assembly 150 and/or one or more connecting structures 160 to enable the platform to move in unison with the sweeper assembly 150 as it traverses the building.

As discussed in further detail below, independent sets of controls may be utilized to control the platform 140 and sweeper assembly 150. The controls may be mechanical, electronic and/or software-based controls. The controls may be located in or near the base unit 124 or carriage situated on the roof of the building 110 and/or located remotely (e.g., inside of the building and/or on a server or computing device which is connected to the precipitation removal system via a network). The platform 140 may also include controls that are utilized to control the movement of platform 140 and/or sweeper assembly 150. In certain embodiments, an individual standing on the platform 140 can utilize the controls to perform maintenance operations (e.g., when the sweeper assembly 150 is stuck is a lowered position).

In certain embodiments, the bar member 151 may also include one or more heating members that assist with the removal of the precipitation on the connecting structures 155, and which eliminate the potential accumulation of precipitation on the sweeper assembly 150 itself. For example, a heating member may be used to heat the precipitation removal tool and/or to apply heat directly to the surface of the connecting structure 160 (or other exterior portion of the building) to assist with the removal of precipitation from the connecting structures 160 and/or sweeper assembly 150. An electrical connection between the hoisting assembly 120 and the sweeper assembly 150 may be utilized to power the heating members. Additionally, or alternatively, the sweeper assembly 150 may utilize one or more rechargeable and/or replicable batteries to power the heating members.

In certain embodiments, the sweeper assembly 150 may include a catch structure that is configured to collect precipitation that is removed from the exterior of the building 110 to prevent the precipitation from falling and striking individuals, vehicles or the like. The catch structure may be attached to, or located near, the bar member 151 to collect precipitation that is removed by the bar member 151.

The width of the sweeper assembly 150 may vary. In certain embodiments, the sweeper assembly 150 may be wide enough to remove precipitation from an entire side of a building. In alternative embodiments, the sweeper assembly may only cover a portion of or subset of an exterior surface of a building. For example, the width of a building side may extend twenty windows wide, but the sweeper assembly may only be wide enough to cover three or five adjacent windows. In this case, several separate sweeper assemblies may be utilized to remove precipitation from a single side of the building. Moreover, the sweeper assembly can be varied to accommodate any surface or shape of a building.

In certain embodiments, the sweeper assembly 150 may be configured to move horizontally along the width of a building to remove precipitation from connecting structures 160 that are situated horizontally with respect to the building 110 or ground surface. To enable the sweeper assembly 150 to move horizontally, the precipitation removal system 100 may include a motorized assembly located on the roof of the building which is coupled to the sweeper assembly 150 and which enables horizontal movement of the sweeper assembly 150. This may also involve attaching the sweeper assembly 150 to one or more horizontal mullions, rails, tracks or other structures (e.g., using attachment sleeves or members similar to those described herein) located on the exterior surface of the building 110 to assist with guiding the horizontal movement of the sweeper assembly 150.

As mentioned above, the configuration of the attachment members 155 can vary. FIGS. 2A-2D illustrate an embodiment of a precipitation removal system 100 that utilizes attachment members 155 comprising sleeves and knuckle connectors to connect the sweeper assembly 150 to the connecting structures 160 of a building 110. FIGS. 3A-3D illustrate another embodiment of a precipitation removal system 100 that utilizes a trolley system to connect the sweeper assembly 150 to the connecting structures 160 of a building 110.

With reference to the embodiment illustrated in FIGS. 2A-2D, the connecting structures 160 are mullions or other similar structures and the attachment members 155 include sleeves 210 that assist the sweeper assembly 150 with moving up and down the mullions. Each sleeve 210 may completely surround an exterior of a mullion and the interior surface of the attachment sleeve 210 may include one or more glide members 220 (and/or one or more glide wheels) that provide assistance with moving the sweeper assembly 150 smoothly along the mullion. In certain embodiments, the body portion of the sleeve 210 may be comprised of a metal or polymer and the glide members 220 and/or wheels may be comprised of nylon, Teflon® or a similar substance that is able to slide along the connecting structure 160. The glide members 220 may be situated between the sleeve 210 and the mullions to prevent the sleeve 210 from contacting the mullions. In certain embodiments, the sleeves 210 may also include one or more precipitation removal tools 170. For example, the precipitation removal tools 170 may include blade members that contact the mullions and which remove precipitation from the mullions. The blade members may be composed of silicone rubber or a similar substance. In certain embodiments, the sleeves 210 include separate blade members at both the top and bottom portions of the sleeves 210. Other types of precipitation removal tools 170 may be utilized.

In the embodiments illustrated in FIGS. 2A-2D, the attachment members 155 utilize a knuckle connector 230 to connect the attachment sleeves 210 to the bar member 151. As discussed in further detail below with respect to FIGS. 3A-3D, a trolley assembly, which includes one or more wheels which guide movement of the sweeper assembly 150 along the connecting structure 160, may be utilized to connect the bar member 151 to the connecting structure 160. Other types of coupling mechanisms may also be utilized by attachment members 155 to connect the bar members 151 to the connecting structures 160. For example, in certain embodiments, the attachment members 155 may alternatively, or additionally, include ball joint connections, wheels that slide between the bar members and attachment members, screw or bolt connections, welded connections, cotter pin connections, hinge joint connections and/or other types of connections. The attachment members 155 (including the coupling mechanisms) and horizontal bar 151 may be comprised of any type of metal (e.g., steel, iron or aluminum) and/or any type of polymer. Preferably, the coupling mechanism utilized by the attachment members 155 is configured to provide a limited amount of "give" such that the bar member 151 is able to move horizontally within a limited range or distance without compromising the integrity of the precipitation removal system 100 and/or building connecting structures 160. This assists with preventing the precipitation removal system 100 from jamming.

Figure 2A:
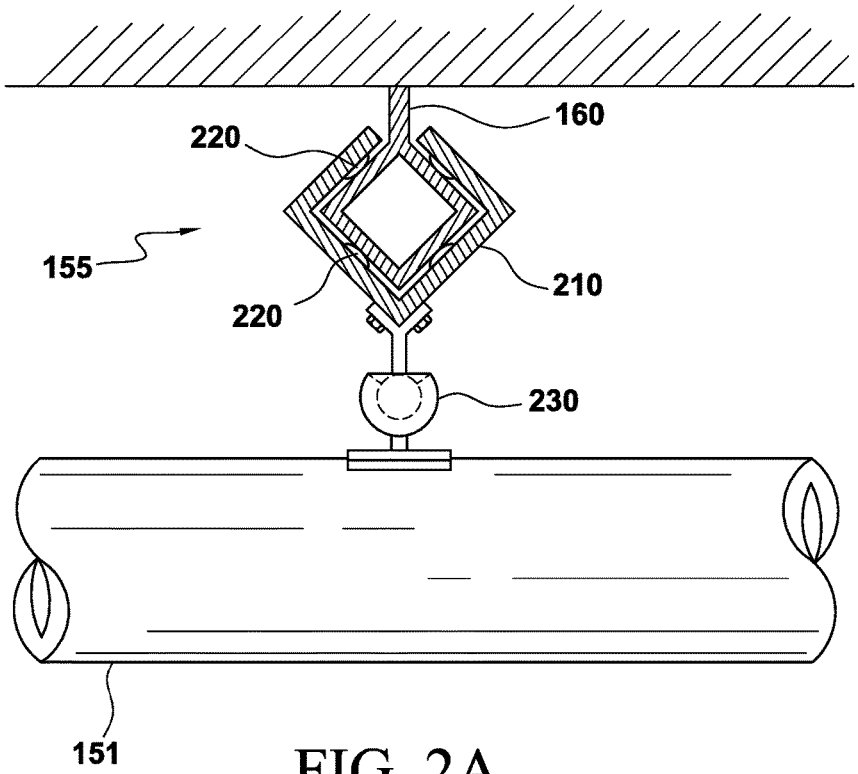
FIG. 2A is a plan view illustrating an exemplary connection scheme for coupling a sweeper assembly to connecting structures located on the exterior of a building in accordance with certain embodiments.

In further detail, FIG. 2A is a plan view illustrating an exemplary coupling mechanism that connects the sweeper assembly 150 to the connecting structure 160 of a building 110 in accordance with certain embodiments. The connecting structure 160 is a diamond-shaped mullion that extends from the building 110, and the attachment member 155 includes a diamond-shaped sleeve 210 that surrounds the mullion, as well as a knuckle connection 230 which couples the sleeve 210 to a bar member 151. The attachment member 155 includes gliding members 220 on the interior surfaces of the sleeve 210 which prevent the sleeve 210 from contacting the mullion and which provide assistance with moving the sweeping assembly 150.

Figure 2B:
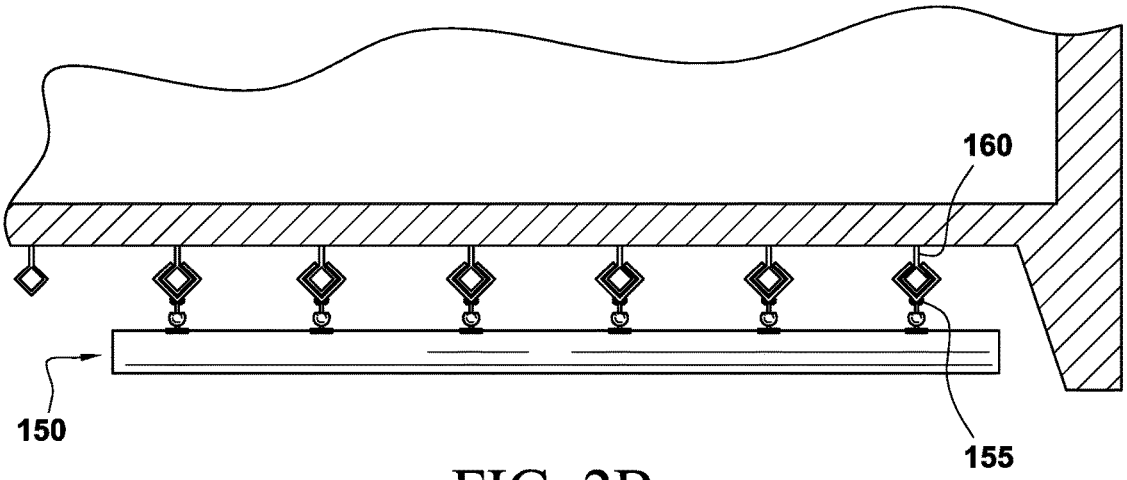
FIG. 2B is a plan view of the exemplary connection scheme shown in FIG. 2A in accordance with certain embodiments.

FIG. 2B is a plan view of the exemplary connection scheme shown in FIG. 2A in accordance with certain embodiments. As shown, the sweeping assembly 150 is connected to a plurality of connecting structures 160 (e.g., diamond-shaped mullions) located on the exterior of a building 110. The sweeper assembly 150 can be controlled by a hoisting system 120 located atop the building 110 (e.g., such as the one shown in FIG. 1).

Figure 2C:
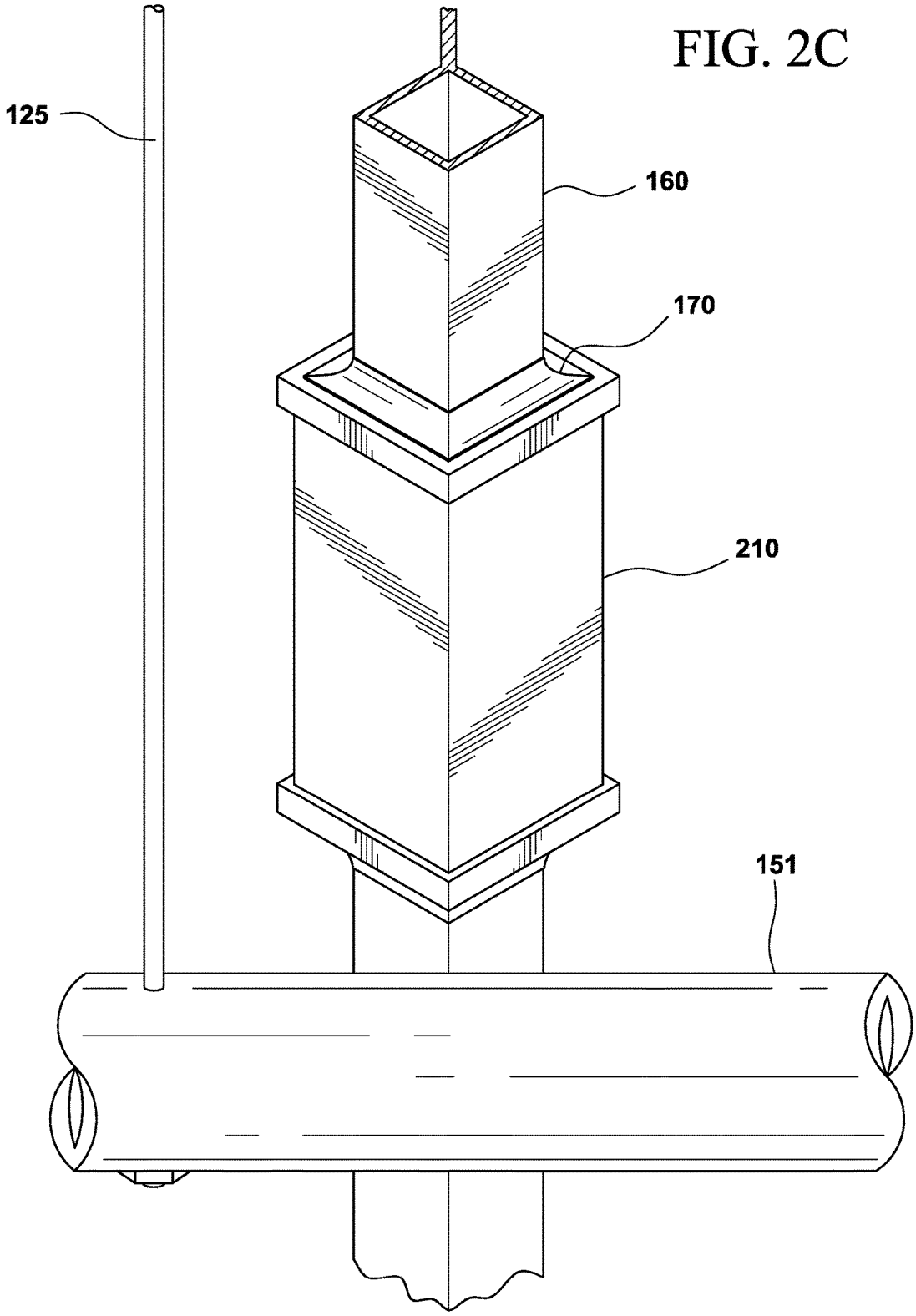
FIG. 2C is an axonometric view of the exemplary connection scheme shown in FIG. 2A in accordance with certain embodiments.

FIG. 2C is an axonometric view of the connection between the sweeper assembly 150 and a mullion connecting structure 160 in accordance with certain embodiments. As mentioned above, the attachment member 155 comprises a sleeve 210 which surrounds the exterior of a portion of the diamond-shaped mullion. Blade members or other precipitation removal tools 170 are included on the attachment sleeve 210 and contact the mullion near the top and bottom portions of the sleeve 210. In certain embodiments, the blade members may be composed of silicon rubber or a similar material.

Figure 2D:
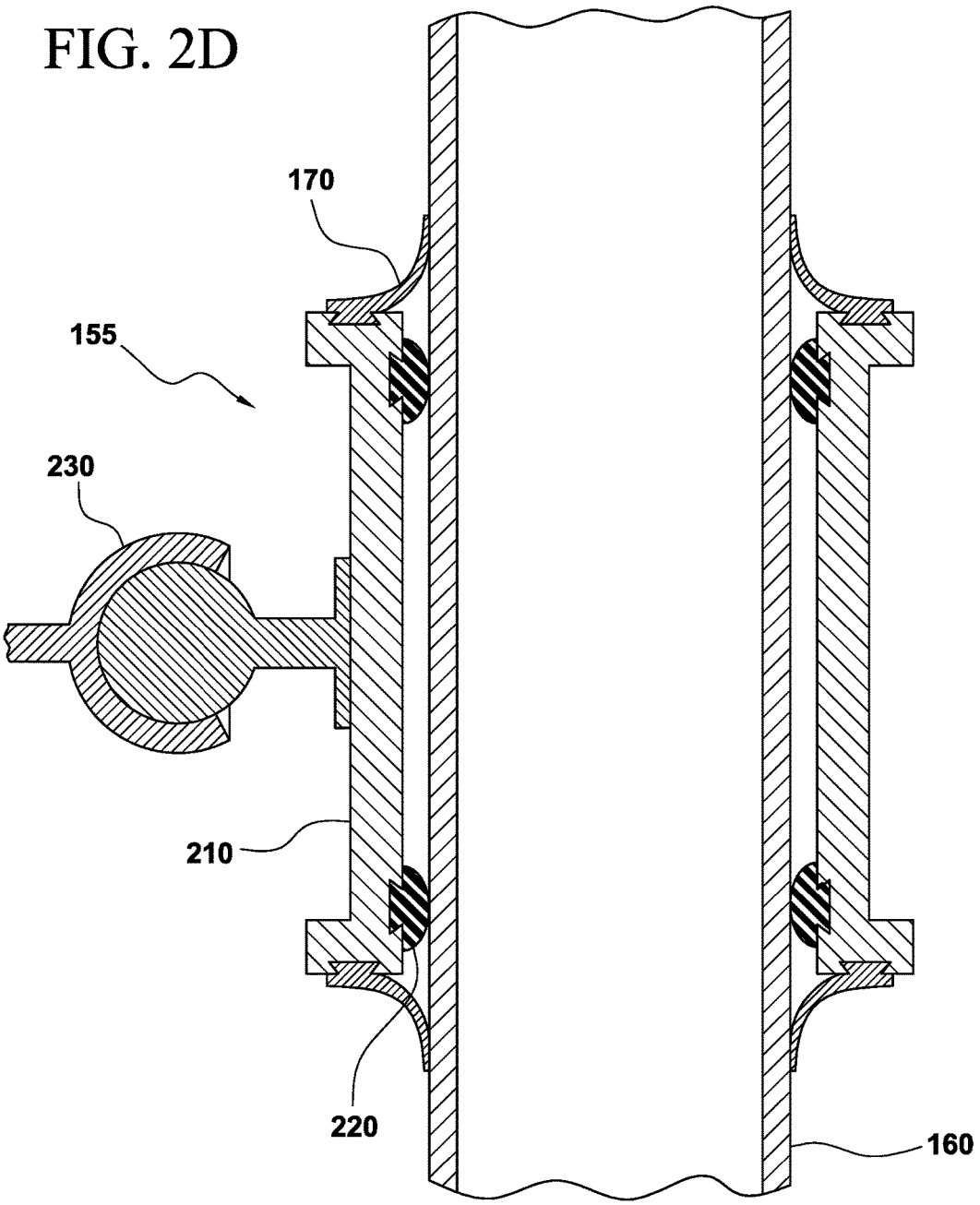
FIG. 2D is a cross-sectional view of the exemplary connection scheme shown in FIG. 2A in accordance with certain embodiments.

FIG. 2D is a cross-sectional view of the connection between a sweeper assembly 150 and a mullion connecting structure 160 in accordance with certain embodiments. Once again, the attachment member 155 includes a sleeve 210 that surrounds the mullion connecting structure 160 and which includes a plurality of glide members 220 and a plurality of blade members. A knuckle connection 230 is used to connect the attachment member 155 to a bar member 151 of the sweeper assembly 150.

Figure 3A:
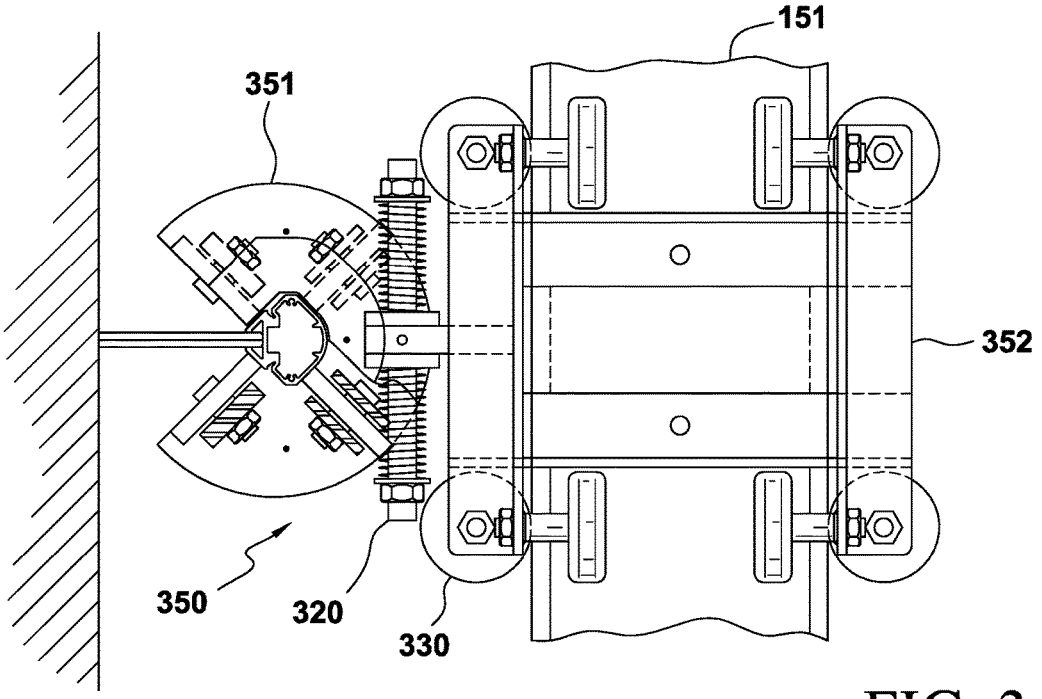
FIG. 3A is a plan view illustrating another exemplary connection scheme which utilizes a trolley system for coupling a sweeper assembly to connecting structures located on the exterior of a building in accordance with certain embodiments.
Figure 3B:
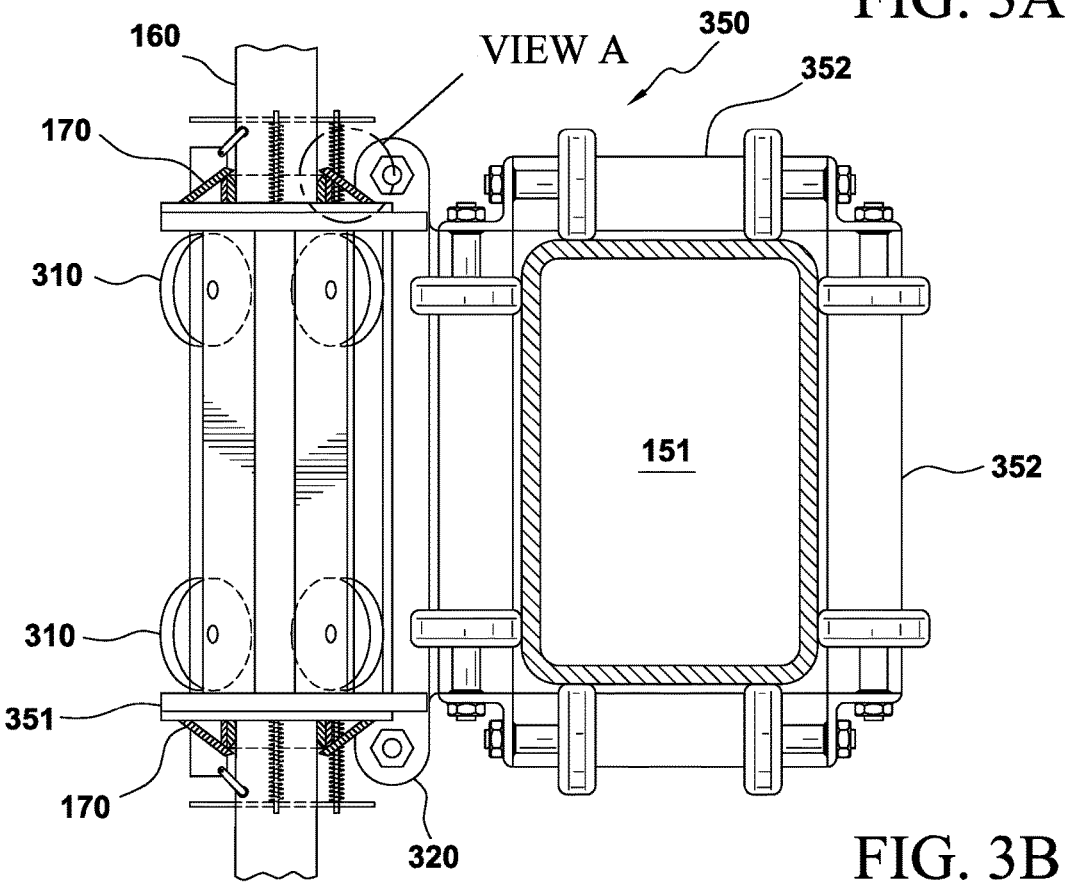
FIG. 3B is a cross-sectional view of the exemplary connection scheme shown in FIG. 3A in accordance with certain embodiments.
Figure 3C:
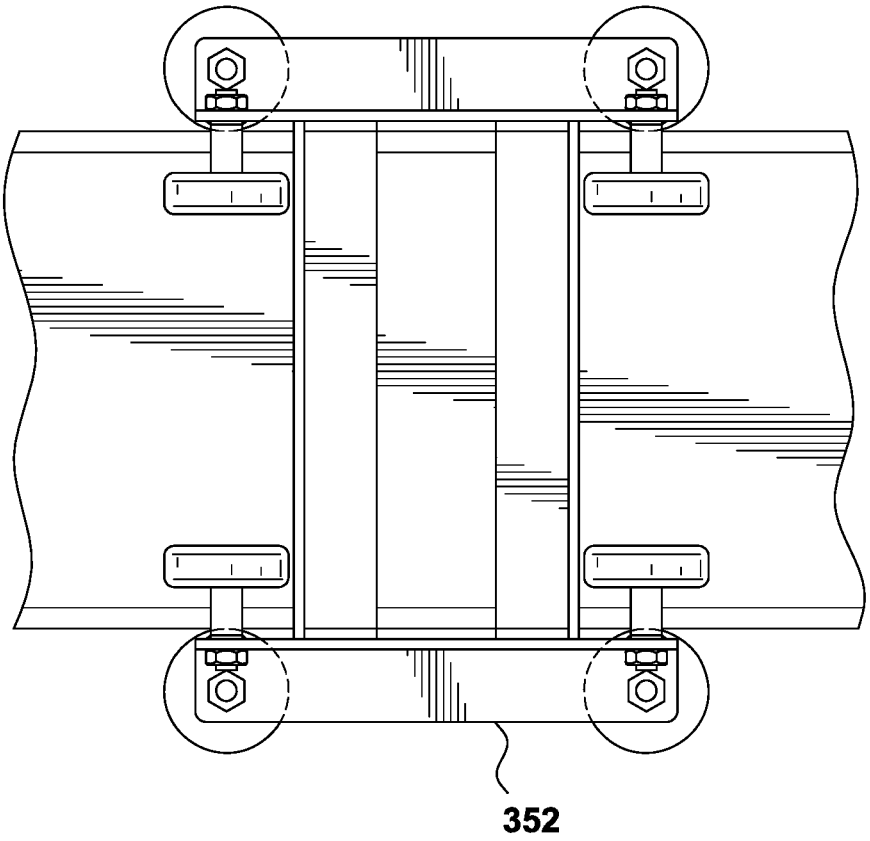
FIG. 3C is a side view of the exemplary connection scheme shown in FIG. 3A in accordance with certain embodiments.
Figure 3D:
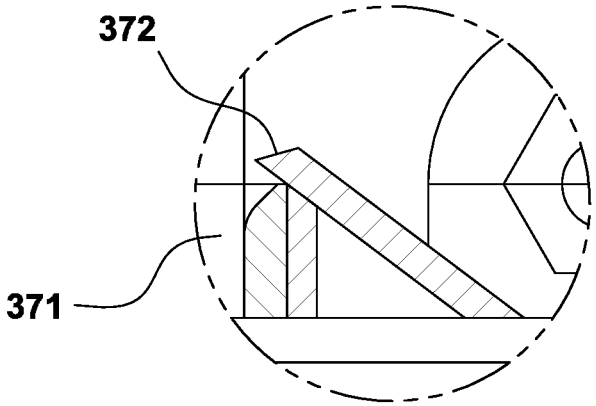
FIG. 3D is an exploded view of an exemplary precipitation removal tool of the exemplary connection scheme shown in FIG. 3B in accordance with certain embodiments.

FIGS. 3A-3D illustrate another embodiment of an exemplary connection scheme whereby the attachment members 155 utilize a trolley system to connect the bar member 151 of the sweeper assembly 150 to the connecting structures 160 of a building 110. FIG. 3A is a plan view illustrating the exemplary connection scheme in accordance with certain embodiments. FIG. 3B is a cross-sectional view of the sweeper assembly 150 utilizing the exemplary connection scheme in accordance with certain embodiments. FIG. 3C provides a side view of the sweeper assembly 150 utilizing the exemplary connection scheme in accordance with certain embodiments. FIG. 3D is an exploded view of an exemplary precipitation removal tool utilized by the sweeper assembly 150 in accordance with certain embodiments.

In the embodiment illustrated in FIGS. 3A-3D, the attachment member 155 which connects the sweeper assembly 150 to the mullion connecting structures 160 includes a plurality of guide wheels 310 which assist the sweeper assembly 150 with traversing the mullion connecting structures 160. The top and bottom portions of the attachment members 155 also include precipitation removal tools 170 which contact the surface of the mullion connecting structure 160 and remove precipitation from the mullion connecting structure 160. In this exemplary embodiment, the attachment member 155 includes a snow removal tool 371 which is made of nylon and an ice removal tool 372 which is made of steel. The snow removal tool 371 may act as a sleeve that contacts and surrounds the mullion, and which removes soft precipitation from the surface of the mullion. FIG. 3D provides a detailed view of an exemplary ice removal tool 372 according to certain embodiments. FIG. 3D provides a detailed illustrated of the portion of FIG. 3B identified by dotted circle as View A. As shown in this view, the ice removal tool 372 may include an inclined surface that contacts and scrapes ice and other precipitation from the surface of the mullion connecting structure 160.

The sweeper assembly 150 further includes a trolley assembly 350 which is connected to both the mullion connecting structure 160 and a bar member 151 which extends horizontally with respect to the exterior of the building 110. More specifically, the trolley assembly 350 is comprised of two main portions: a first portion 351 which is connected to the connecting structure 160 and a second portion 352 which is connected to the bar member 151. The first portion 351 and second portion 352 of the trolley assembly 350 are connected using a pair of clamping springs 320 which are situated between the first portion 351 and second portion 352, and which are located near the upper and bottom portions of the trolley assembly 350. The bar member 151 extends through the center of the second portion 352 of the trolley assembly 350 and is supported by the trolley assembly. The trolley assembly includes a plurality of wheels 330 which enable the bar member 151 to move back-and-forth horizontally within a limited range of movement. In this exemplary embodiment, the first portion of the first portion 351 of the trolley assembly 350 includes four wheels 310 and the second portion 352 includes four wheels 330. However, it should be recognized that any number of wheels 310 and 330 may be utilized.

Figure 4B:
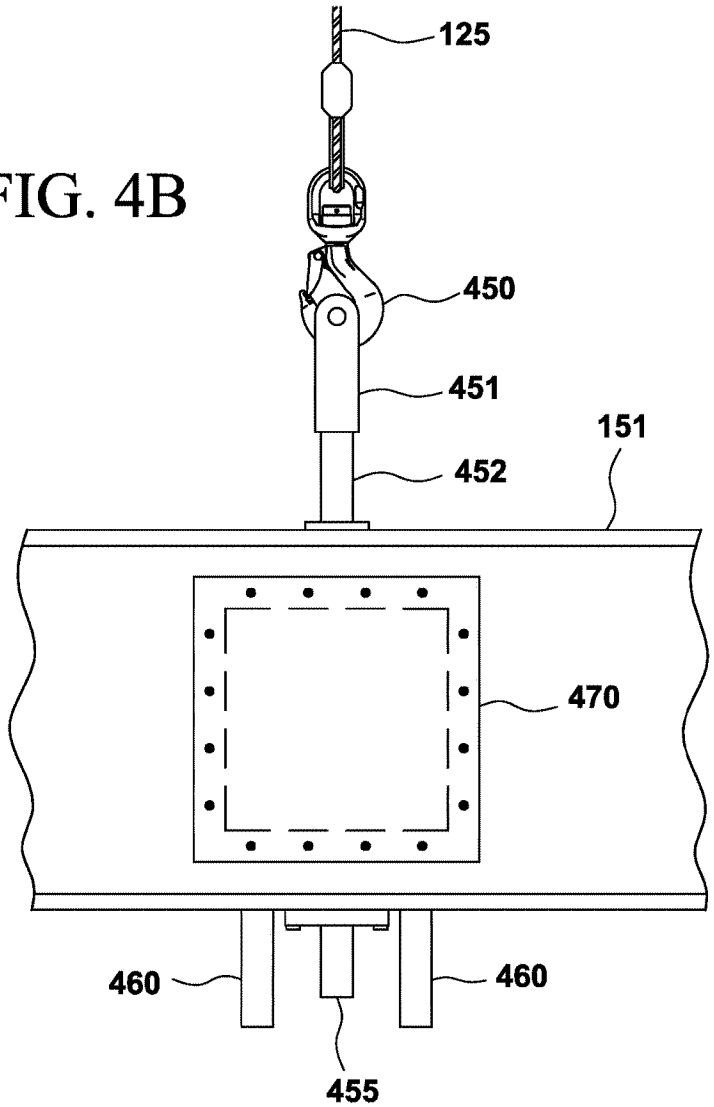
FIG. 4B is a side view of a connection between a sweeper assembly and a hoisting system in accordance with certain embodiments.
Figure 4A:
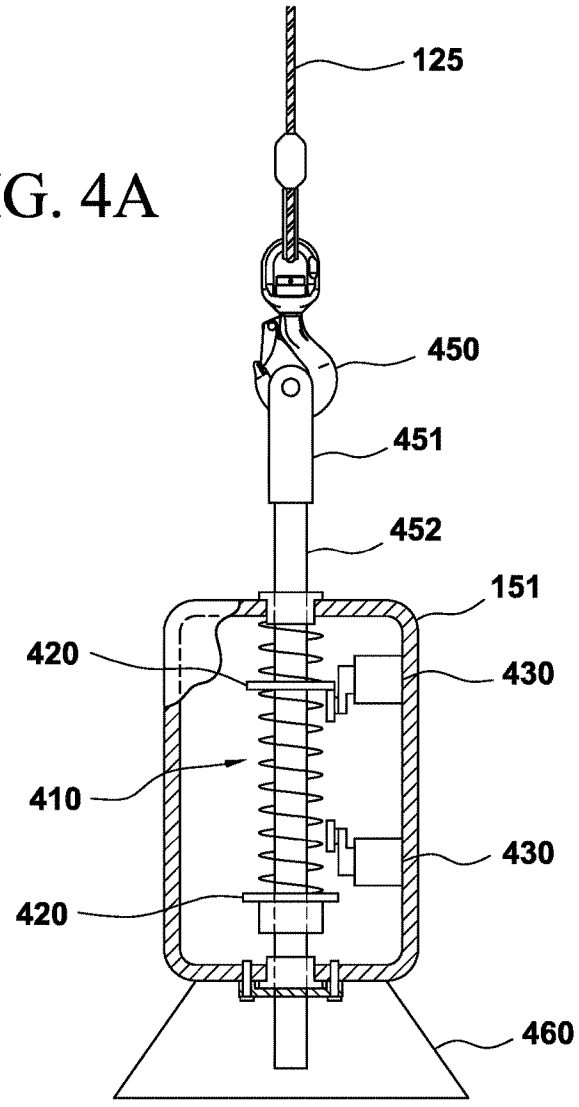
FIG. 4A is a cross-sectional view of a connection between a sweeper assembly and a hoisting system in accordance with certain embodiments.
Figure 5A:
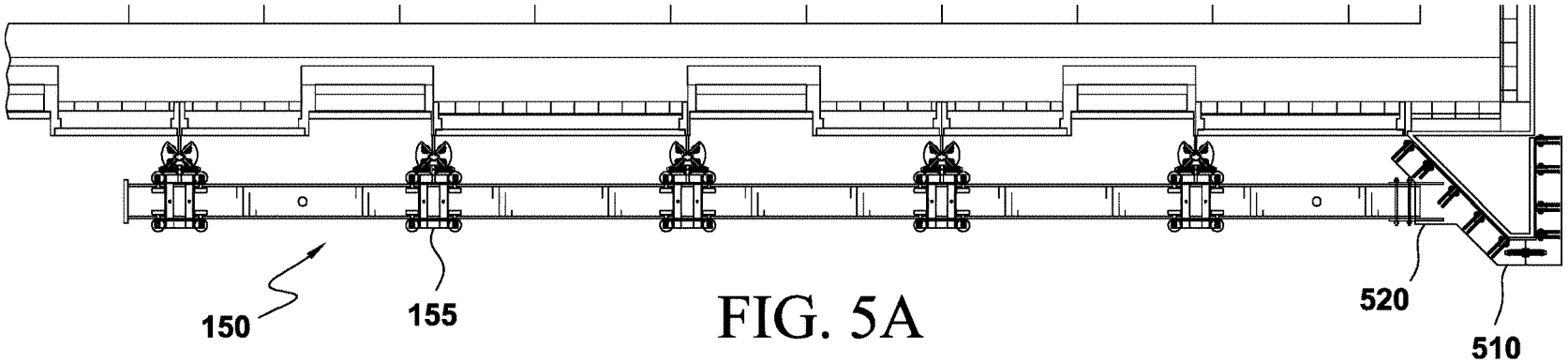
FIG. 5A is top view of a sweeper assembly that is attached to the exterior of a building that includes an protruding surface structure in accordance with certain embodiments.
Figure 5B:
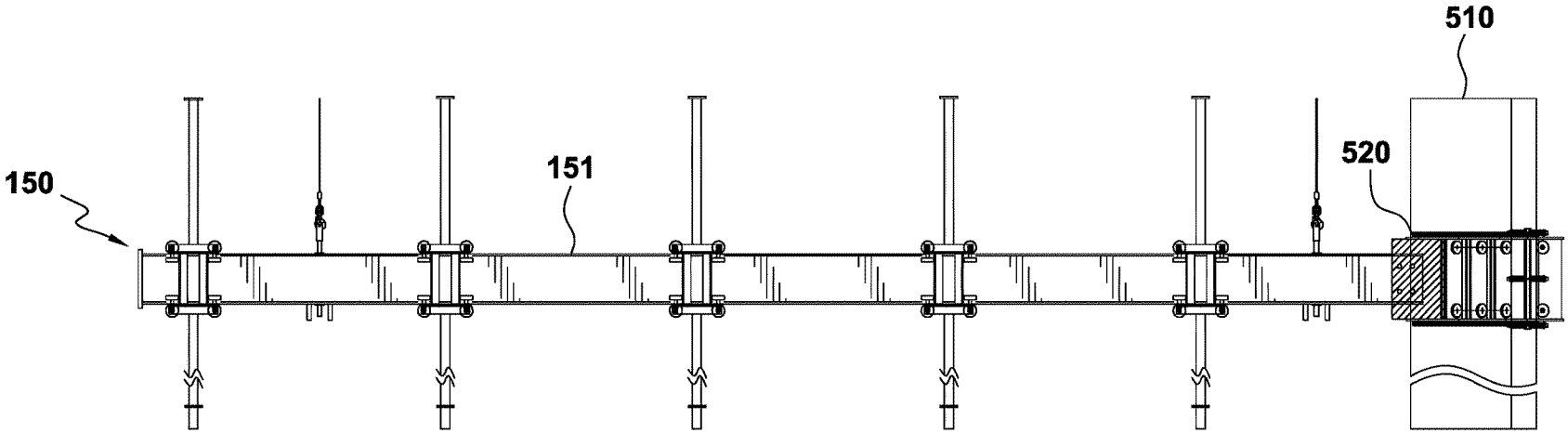
FIG. 5B is side view of a sweeper assembly that is attached to the exterior of a building that includes a protruding surface structure in accordance with certain embodiments.
Figure 5C:
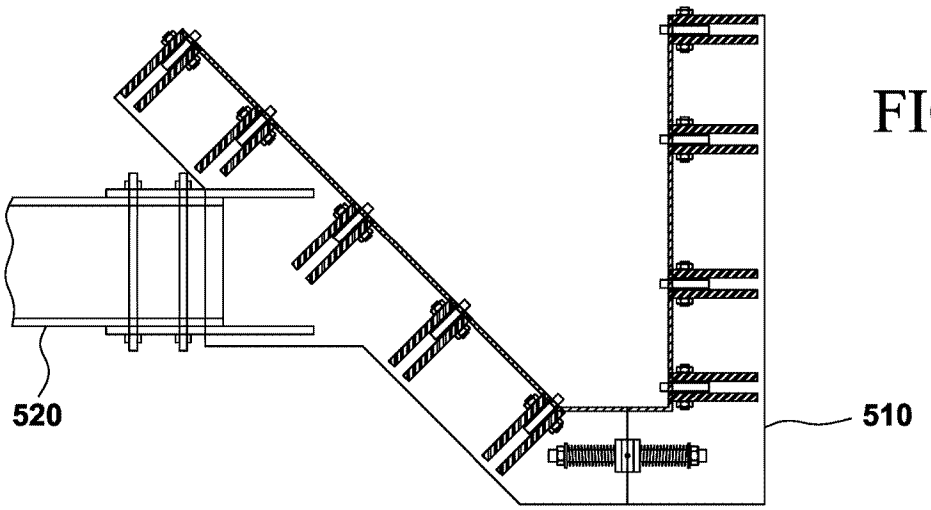
FIG. 5C is top view of a connection between a sweeper assembly and a protruding surface structure of building in accordance with certain embodiments.
Figure 5E:
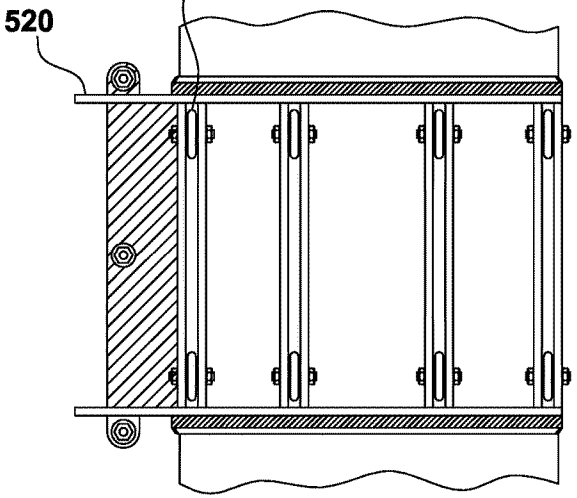
FIG. 5E is side view of a connection member that connects a sweeper assembly to a protruding surface structure of building in accordance with certain embodiments.
Figure 5D:
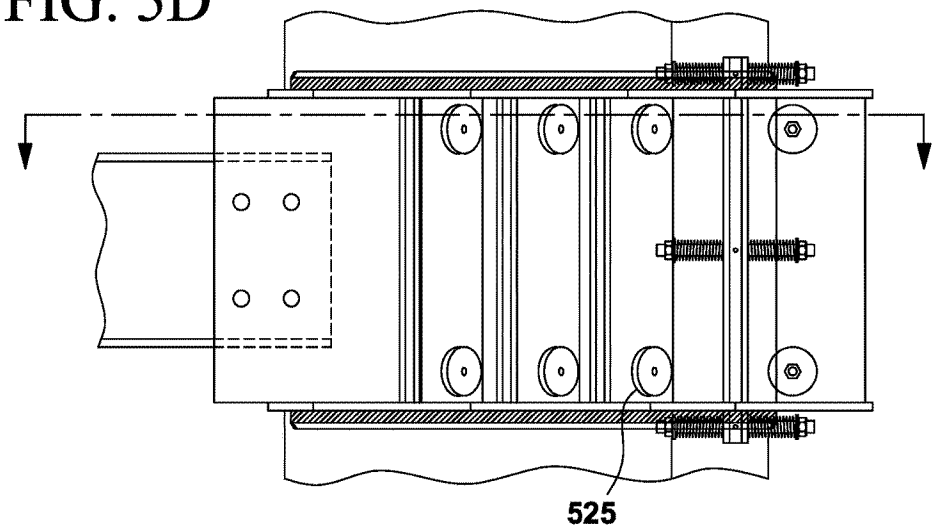
FIG. 5D is side view of a connection between a sweeper assembly and a protruding surface structure of building in accordance with certain embodiments.

FIGS. 4A-4B illustrate the connection between a sweeper assembly 150 and a hoisting system 120 in accordance with certain embodiments. Specifically, FIG. 4A is a cross-sectional view which illustrates a connection between a sweeper assembly 150 and a hoisting system 120 in accordance with certain embodiments, and FIG. 4B is a side view illustrating a connection between a sweeper assembly 150 and a hoisting system 120 in accordance with certain embodiments.

The cables 125 of the hoisting assembly 120 include a connector 150 which attaches the hoisting assembly 120 to the bar member 151. In this exemplary embodiment, the connector 450 includes a hook which attaches to a handle 451 that extends upwardly from the bar member 151. The lower portion of the handle 451 is attached to a rod member 452 which extends through the center of the bar member 151. Press fit bushings are located at openings on the top and bottom of the bar member 151 where the rod member 452 is received through the bar member 151. A bottom portion 455 of the rod member extends through the bottom of the bar member 151. In certain embodiments, one or more landing structures 460 (e.g., feet structures) extend downwardly from the lower portion of the bar member 151. The landing structures 460 are configured to contact a ground or surface, and to support the weight of the sweeper assembly 150 when the sweeper assembly 150 is fully retracted. For example, the sweeper assembly 150 can rest upon the landing structures 460 when the sweeper assembly 150 is completely retracted and are in contact with a lower surface located at the bottom, end portions of the connecting structures 160.

The cross-sectional view of the bar member 151 in FIG. 4A shows a spring assembly 410 included within the bar member 151. More specifically, the center portion of the rod member 452 located within the bar member 151 includes the spring assembly 410. The spring assembly includes slack and overload components 430 for controlling slack limits and overload limits associated with the cables 125 that connect the bar member 151 to the hoisting assembly 120. The slack and overload components 430 restrict the expansion and retraction of the spring assembly 410 within the range permitted by the structures 420. Specifically, an overload limit component restricts upward movement of the spring assembly 410 based on a maximum allowable weight, while a slack limit component restricts downward movement of the spring assembly 410 based on a maximum allowable amount of cable slack.

As shown in FIG. 4B, the sides of the bar members 151 include removable access panels 470. The removable access panels 470 on the bar member 151 permit individuals to access the spring assembly 410 (e.g., for maintenance or other reasons). For example, as explained above, an individual may utilize the retractable platform 140 to perform maintenance on the sweeper assembly 150, and the removable access panels 470 may permit the individual to perform maintenance on the spring assembly 410 and/or other components included within the bar member 151.

In certain scenarios, the exterior surface a building may not be uniform and the configuration of the sweeper assembly 150 can be configured to accommodate varying surface structures. FIGS. 5A-5E illustrate an example how the sweeper assembly 150 can be configured to accommodate a protruding surface structure 510 of a building. In this example, the protruding surface structure 510 is located near the corner of the building 150 and the sweeper assembly 150 includes a connection member 520 that attaches the sweeper assembly 150 to the protruding surface structure 510 and which permits the sweeper assembly 150 to move along the surface of the protruding surface structure 510. The connection member 520 includes a plurality of wheels 525 which permit the connection member 520 to move along the surface of the protruding surface structure 510. The connection member 520 is attached to the end of the bar member 151 and is angled outwardly from the bar member 151 to be aligned substantially parallel with the protruding surface structure 510. In certain embodiments, the connection member 520 may include one or more precipitation removal tools 170 that permit precipitation to be removed from the surface of the protruding surface structure 510. The configuration of the sweeper assembly 150 in FIGS. 5A-5E is only one example of how the sweeper assembly 150 can be varied to accommodate a protruding surface structure 510. However, it should be recognized that other types of variations may be made to the sweeper assembly 150 to account for other types of protruding surface structures 510.

Figure 6:
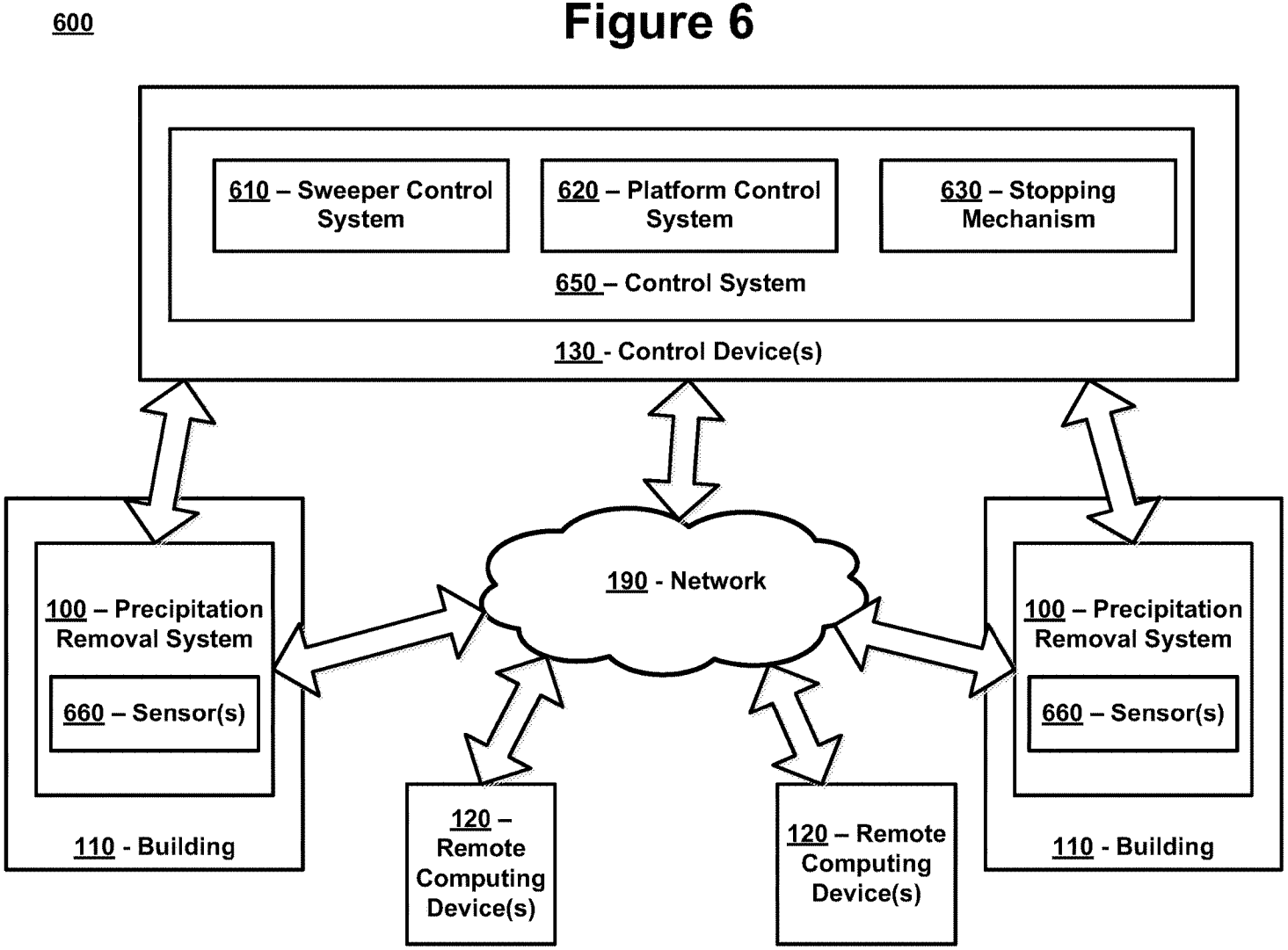
FIG. 6 is a block diagram of an exemplary system for controlling the precipitation removal system in accordance with certain embodiments.

FIG. 6 is a block diagram of an exemplary system 600 for controlling the precipitation removal system 100 in accordance with certain embodiments. The manner in which the precipitation removal system 100 is controlled and operated may vary. In certain embodiments, a control system 650 (e.g., which may include levers, buttons or the like) included on one or more control devices 130 may be used to activate and deactivate the precipitation removal system 100, as well as to cause the vertical and/or horizontal movement of the sweeper assembly 150 and platform 140. In certain embodiments, the control system 650 is implemented, at least in part, utilizing software that is stored one or more control devices 130.

The control system 650 may activate the precipitation removal system 100 in response to a command from an individual (e.g., by activating an on switch) or automatically in response to detecting precipitation (e.g., in response to precipitation being detected by sensors 660 located on the exterior of the building 110). The control system 650 may be located on the roof of the building 110 (e.g., near the hoisting assembly), on the platform 140 that is suspended from building 110, inside of the building 110, or in any other location. In certain embodiments, the precipitation removal system 100 may be operated by one or more remote computing devices 120 that are located remotely with respect to the precipitation removal system 110. For example, the remote computing devices 120 may be located in an office or room in the building 110 and/or in any other location outside the building 110 (e.g., in a location with or without visibility of the precipitation removal system 100). The control system 650 can be stored on one or more control devices 130 that are configured to control the operation of the precipitation removal system 100, and remote computing device 120 can communicate with the control devices 130 to enable a remotely located individual (e.g., administrator) to control the precipitation removal system 100.

The control devices 130 and remote computing devices 120 may represent desktop computers, laptop computers, computing terminals, mobile devices (e.g., smart phones or tablet devices), kiosks, servers or other types of computing devices. Each may be equipped with one or more computer storage devices (e.g., RAM, ROM, PROM, SRAM, etc.) and one or more processing devices (e.g., a central processing unit) that are capable of executing computer program instructions. The computer storage devices are preferably physical, non-transitory mediums. The storage medium can store applications, software code, databases and other data that is related to controlling the operation of the sweeper assembly 150, platform 140 and other components of the precipitation removal system 100.

The one or more control devices 130 and remote computing devices 120 may be configured to communicate directly or indirectly with each other and with other components of the precipitation removal system 100 via wired or wireless links, or a combination of the two. In certain embodiments, the components of the precipitation removal system 100 and computing devices (e.g., control device 130 and remote computing devices 120) communicate over a network 190. The network 190 may be any type of network such as one that includes a local area network, a personal area network, a wide area network, an intranet, the Internet, etc.

In certain embodiments, the control device 130 may represent a server (or a plurality of servers) which is connected to the network 190. The one or more remote computing devices 120 and the precipitation removal system 100 may communicate with the control device 130 over the network 190. An administrator or other individual may utilize one or more control devices 130 and/or one or more remote computing devices 120 to remotely control the precipitation removal system 100 utilizing the control system 650 provided on the control device 130. Generally speaking, the control device 130 may represent any type of computing device that is capable of communicating over the network 190 and/or capable of communicating with the precipitation removal system 100. In some embodiments, the control device 130 comprises one or more mainframe computing devices that execute a web server for communicating with the computing devices 120 and one or more precipitation removal systems 100 over the Internet. The storage medium on the control device 130 can store applications, software code, databases and other data that is related to controlling the components of the precipitation removal systems.

In certain embodiments, the control device 130 (and/or remote computing device 120) may host a platform that allows an individual to control precipitation removal systems at a plurality of different locations. For example, a company may be responsible for installing, operating and/or maintaining precipitation removal systems 100 for a plurality of different buildings. An individual associated with the company may access the platform to control the precipitation removal systems 100 at the various locations. In certain embodiments, the control system 650 includes a sweeper control system 610 and a platform control system 620 which includes functions for controlling all aspects of the sweeper assembly 150 and platform 140, respectively. For example, the sweeper control system 610 and a platform control system 620 can include functions for activating/deactivating the sweeper assembly 150 and platform 140, functions for selecting triggering events that will automatically activate/deactivate the sweeper assembly 150 and platform 140 in respect to detecting certain events (e.g., in response to detecting precipitation events or jamming events), functions for selecting precipitation removal tools 170 that are to be utilized by the sweeper assembly 150 (e.g., for activating heating tools on the sweeper assembly), and/or functions for viewing live video feeds generated by cameras that are included on the sweeper assembly 150 and platform 140.

In certain embodiments, the precipitation removal system 100 may be configured to automatically activate itself in response to detecting a precipitation event (e.g., a rain, snow or hail storm) or in response to detecting an accumulation of precipitation on the exterior of the building. This may be based, at least in part, on the settings of the sweeper control system 610. In order to do so, the precipitation removal system 100 may include or communicate with sensor devices 660 that are located on the device itself (e.g., on the sweeper assembly 155) and/or on the building 110. Alternatively, or in addition, video cameras with appropriate video analysis software may be utilized to detect precipitation events and/or an accumulation of precipitation. The control system 650 can communicate with the sensors 660 and other devices which can detect a precipitation event, and will activate the sweeper assembly 150 when precipitation events are detected. Regardless of the particular detection mechanism that is utilized, the precipitation removal system may automatically activate itself and begin removing precipitation.

In certain embodiments, the control system 650 of the precipitation removal system 100 may include an automated stopping mechanism 630 that is configured to halt or terminate movement of the sweeper assembly 150 in response to detecting that the system is malfunctioning and/or in response to detecting obstructions or in response to other adverse conditions. For example, the stopping mechanism may be activated to halt movement of the sweeper assembly 150 in any or all of the following situations: (1) it is determined that the sweeper assembly 150 is stuck (e.g., which may be detected by spring assemblies 410 located at the connection point inside of the bar member 151 if the tension experienced by the spring assemblies is below a threshold level); (2) it is determined that the sweeper assembly 150 is pulling on the hoisting assembly (e.g., which may be detected by the spring assemblies 410 if the tension experienced by the spring assemblies is above a threshold level); or (3) it is determined that an object or precipitation is obstructing or will obstruct movement of the sweeper assembly 150. The automated stopping mechanism 630 may be activated for other reasons as well.

The manner in which the stopping mechanism 630 is activated may vary. In certain embodiments, one or more sensors 660 are utilized to detect obstructions and/or when the system is malfunctioning. Any appropriate sensor 660 may be utilized to detect stopping events for activating the stopping mechanism including, but not limited to, load sensors, video sensors, and proximity sensors. For example, load sensors may be included in the spring assembly 410 and/or hoisting assembly 120 to determine when the tension between the cables 125 and the bar member 151 has fallen below or has risen above predetermined threshold levels. Likewise, video sensors included on the sweeper assembly 150 (or elsewhere) can determine if obstructions are present in the upcoming path of the sweeper assembly 150. In response to detecting a stopping event, a wired or wireless signal can be transmitted to activate the stopping mechanism (e.g., the signal can be transmitted to the control device 130, the hoisting system 120 and/or other component of the precipitation removal device 100).

Figure 7:
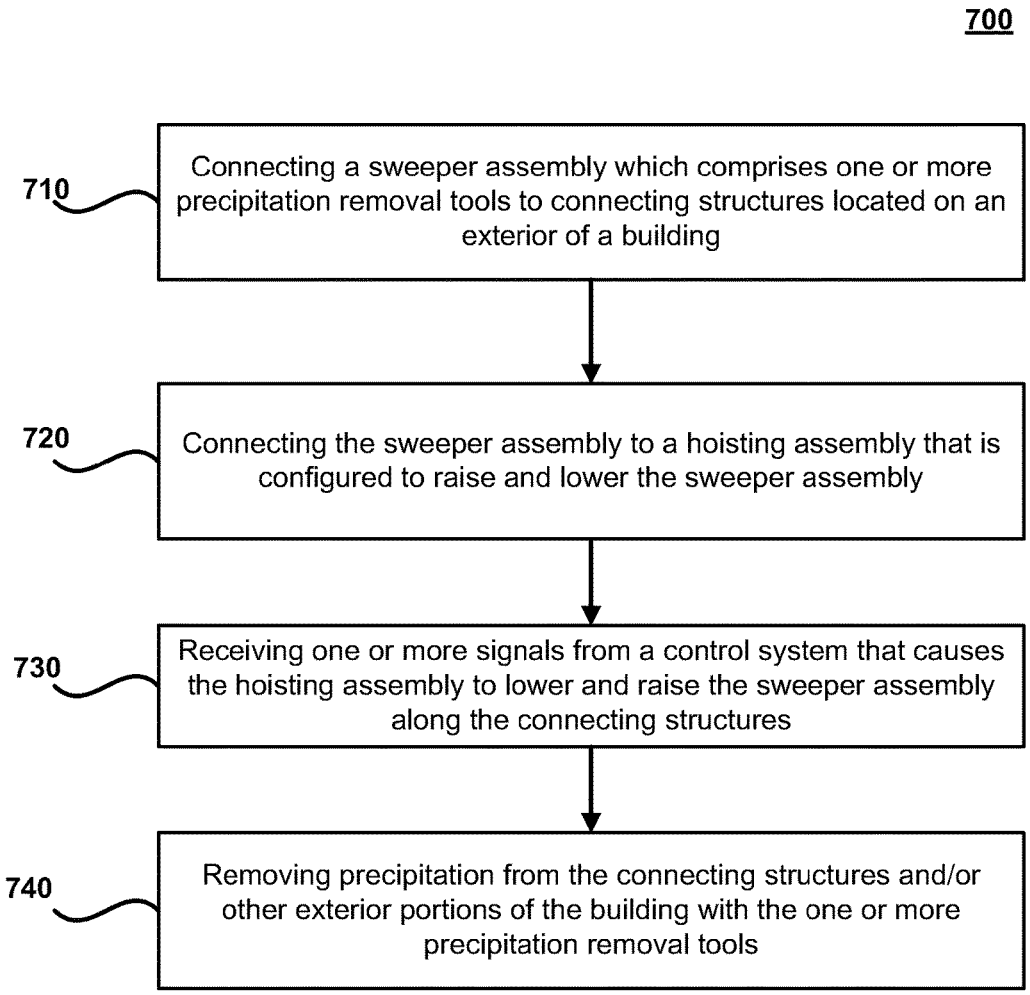
FIG. 7 is a flow chart illustrating an exemplary method of utilizing the precipitation removal system in accordance with certain embodiments.

FIG. 7 is a flow chart illustrating an exemplary method 700 of utilizing the precipitation removal system in accordance with certain embodiments.

In step 710, a sweeper assembly 150 which comprises one or more precipitation removal tools 170 is connected to connecting structures 160 located on an exterior of a building 110. As mentioned above, the sweeper assembly 150 may include attachment members 155 which connect the sweeper assembly 150 to the connecting structures 160, and the attachment members 155 and connecting structures 160 can be configured in various ways (e.g., using corresponding male and female connectors) to facilitate the connection. FIGS. 2A-2D and 3A-3D illustrate exemplary techniques for connecting the sweeper assembly to the connecting structures 160.

In step 720, the sweeper assembly 150 is connected to a hosting system 120 that is configured to raise and lower the sweeper assembly 150. In certain embodiments, the hosting assembly 120 may include one or more davit structures 121 that utilize motorized winches to raise and lower the sweeper assembly 150. FIG. 1A illustrates an exemplary technique for connecting the sweeper assembly 150 to a hoisting system 120.

In step 730, one or more signals are received from a control system 650 that causes the hoisting assembly 120 to lower and raise the sweeper assembly 150. The signals may be received directly from the control system and/or over a network 190. The signals may be transmitted by a control device 130 and/or a remote computing device 120. FIG. 6 illustrates an exemplary control system 650 for controlling the sweeper assembly 150.

In step 740, precipitation is removed from the connecting structures 160 and/or other exterior portions of the building 110 using the one or more precipitation removal tools 170. The precipitation removal tools 170 may include sleeves or scraping devices which are configured to remove ice, snow and other forms of precipitation from the connecting structures 160 and building 110.

The embodiments described in this disclosure can be combined in various ways. The features or aspects of various example embodiments may be mixed and matched (even if such combination is not explicitly described herein) without departing from the scope of the invention. Any aspect or feature that is described for one embodiment can be incorporated to any other embodiment mentioned in this disclosure.

Accordingly, while various novel features of the invention have been shown, described and pointed out as applied to particular embodiments thereof, it should be understood that various omissions and substitutions and changes in the form and details of the systems and methods described and illustrated, may be made by those skilled in the art without departing from the spirit of the invention. Amongst other things, the steps of the methods may be carried out in different orders in many cases where such may be appropriate. Those skilled in the art will recognize, based on the above disclosure and an understanding therefrom of the teachings of the invention, that the particular hardware and devices that are part of the system described herein, and the general functionality provided by and incorporated therein, may vary in different embodiments of the invention. Accordingly, the particular system components are for illustrative purposes to facilitate a full and complete understanding and appreciation of the various aspects and functionality of particular embodiments of the invention as realized in system and method embodiments thereof. Those skilled in the art will appreciate that the invention can be practiced in other than the described embodiments, which are presented for purposes of illustration and not limitation.

What is claimed is:

1. A precipitation removal system configured to remove precipitation from an exterior of a building, the system comprising:

a sweeper assembly that is configured to traverse the exterior of the building and remove precipitation from the exterior of the building, the sweeper assembly comprising:

a plurality of attachment members that connect the sweeper assembly to connecting structures located on the exterior of the building;

one or more precipitation removal tools attached to the sweeper assembly that are configured to remove precipitation from the connecting structures; and a bar member that is connected to the plurality of attachment members; and a hoisting assembly that is connected to the sweeper assembly and which is configured to lower and raise the sweeper assembly along the exterior of a building.

2. The system of claim 1, wherein:

the hoisting assembly is situated on the roof of the building and includes an arm that extends over a ledge of the building;

the bar member extends horizontally with respect to the building and is connected to at least one cable that extends from the arm of the hoisting device; and the hoisting assembly is configured to extend and retract the at least one cable to enable the hoisting assembly to move the sweeper assembly vertically along the connecting structures.

3. The system of claim 1, wherein the one or more precipitation removal tools include one or more sleeves, wipers or scrapers that are configured to remove ice, snow and other forms of precipitation from the connecting structures and the one or more precipitation removal tools are comprised of a polymer or a metal.

4. The system of claim 1, wherein the plurality of attachment members and connecting structures are configured to mate using corresponding male and female structures.

5. The system of claim 1, further comprising:

a platform which is attached to and supported by at least one second cable that is connected to the hoisting assembly, wherein the platform is configured to be connected to the connecting structures located on the exterior of the building and is configured to vertically traverse the side of the building.

6. The system of claim 1, further comprising:

an automated stopping mechanism that is configured to halt or terminate movement of the sweeper assembly in response to detecting that the precipitation removal system is malfunctioning or in response to detecting obstructions.

7. The system of claim 1, further comprising:

one or more sensors that are configured to detect precipitation events and stopping events.

8. The system of claim 1, further comprising:

a control system that is configured to activate, deactivate and control the precipitation removal system, the control system including one or more computing devices.

9. The system of claim 8, wherein the control system can be configured to automatically activate the precipitation removal system in response to detecting precipitation.

10. The system of claim 8, wherein the control system is accessible over a network to enable a remotely located individual to activate, deactivate and control the precipitation removal system.

* * * * *